US012715665B2

(12) United States Patent
Paquette et al.

(10) Patent No.: US 12,715,665 B2
(45) Date of Patent: Aug. 25, 2026

(54) BEVERAGE BOTTLE AND DYNAMIC STRAW

(71) Applicant: Under Armour, Inc., Baltimore, MD (US)

(72) Inventors: Adam Paquette, Baltimore, MD (US); Brandon Stroud, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 18/644,277

(22) Filed: Apr. 24, 2024

(65) Prior Publication Data

US 2025/0229954 A1 Jul. 17, 2025

Related U.S. Application Data

(60) Provisional application No. 63/498,215, filed on Apr. 25, 2023.

(51) Int. Cl.
*B65D 47/06* (2006.01)
*B65D 77/28* (2006.01)

(52) U.S. Cl.
CPC ..... *B65D 47/06* (2013.01); *B65D 77/283* (2013.01); *B65D 2517/0049* (2013.01)

(58) Field of Classification Search
CPC ..... A47G 21/18; A47G 21/186; B65D 51/20; B65D 51/18; B65D 47/063; B65D 47/061; B65D 47/06; B65D 77/28; B65D 77/283; B65D 77/286; B65D 43/26; B65D 2517/0049
See application file for complete search history.

(56) References Cited

U.S. PATENT DOCUMENTS 942,306 A * 12/1909 Clarke ..... A47G 21/18 215/388
4,461,406 A * 7/1984 Vannucci ..... B65D 51/20 222/530
5,253,779 A 10/1993 Lee
7,513,388 B2 * 4/2009 Maher ..... B65D 51/185 220/709
7,516,869 B1 * 4/2009 Hajianpour ..... B65D 77/283 215/388

(Continued)

FOREIGN PATENT DOCUMENTS

EP 2532601 B1 5/2014

*Primary Examiner* — Javier A Pagan
(74) *Attorney, Agent, or Firm* — Maginot, Moore & Beck, LLP

(57) ABSTRACT

A beverage bottle includes a liquid reservoir, a spout, and a straw. The liquid reservoir defines an upper end and a lower end of the bottle. The spout is positioned at the upper end of the liquid reservoir. The straw extends from the upper end to the lower end of the liquid reservoir and includes a proximal end and a distal end. The proximal end of the straw is configured to extend through the spout and the distal end of the straw is configured to engage the lower end of the liquid reservoir. The distal end of the straw includes a resilient hinge moveable between an axial position and a bent position. The proximal end of the straw extends through the spout when the resilient hinge is in the axial position and is withdrawn into the spout when the resilient hinge is in the bent position.

18 Claims, 4 Drawing Sheets

(56) References Cited

U.S. PATENT DOCUMENTS

| | | | | |
|---|---|---|---|---|
| 8,042,701 | B2 * | 10/2011 | Raman | B65D 77/283 215/229 |
| 9,150,335 | B2 * | 10/2015 | Lane | A45F 3/18 |
| 2002/0079320 | A1 | 6/2002 | McCarthy et al. | |

* cited by examiner

BEVERAGE BOTTLE AND DYNAMIC STRAW

CROSS-REFERENCE TO RELATED APPLICATIONS

The present application claims priority to U.S. provisional patent application No. 63/498,215, filed Apr. 25, 2023, the entire contents of which are incorporated herein by reference.

FIELD

The present disclosure relates to the field of water bottles, and particularly straws for use in association with water bottles.

BACKGROUND

Beverage bottles, commonly referred to as "water bottles," are widely used to provide users with convenient access to a beverage during athletic events and other activities. Some water bottles include a straw that is used to suck liquid from the water bottle. However, straws are often inconvenient for use with water bottles, as they typically have a length equal to that of the water bottle and the top of the straw tends to float or otherwise find an equilibrium position below or near either (i) an opening in the bottle or (ii) the surface of the liquid in the bottle. When the user wants to use the straw, they must fish the straw away from the opening or surface of the liquid in order to place their mouth on the top of the straw. The act of fishing a straw away from the bottle opening and/or surface of the liquid may involve the use of fingers or other objects. The act of fishing the straw out of a bottle is not only inconvenient, but may also result in contamination of the liquid in the bottle. In view of the foregoing, it would be desirable to provide a straw for a water bottle that is configured to provide a user with access to the top of the straw during use of the water bottle. It would also be desirable to provide the user with the ability to contain the straw within the water bottle when the water bottle is not in use.

SUMMARY

In at least one embodiment, a beverage bottle includes a liquid reservoir, a spout, and a straw. The liquid reservoir defines an upper end and a lower end of the bottle. The spout is positioned at the upper end of the liquid reservoir. The straw extends from the upper end to the lower end of the liquid reservoir and includes a proximal end and a distal end. The proximal end of the straw is configured to extend through the spout and the distal end of the straw is configured to engage the lower end of the liquid reservoir. The distal end of the straw includes a resilient hinge moveable between an axial position and a bent position. The proximal end of the straw extends through the spout when the resilient hinge is in the axial position. The proximal end of the straw is withdrawn into the spout when the resilient hinge is in the bent position. The resilient hinge is biased toward the axial position.

In at least one embodiment, a straw includes a proximal end, an elongated central portion, and a distal end. The proximal end includes an enlarged portion and a drinking tip. The elongated central portion is coupled to the proximal end and defines an axis. The distal end is coupled to the elongated central portion and includes a resilient hinge configured to permit the distal end to move between an axial position and a bent position. The distal end is substantially aligned with the axis when in the axial position. The distal end is misaligned with the axis when in the bent position. The resilient hinge is also biased toward the axial position.

In at least one embodiment, a method is disclosed for making a straw available for use in drinking from a beverage bottle. The method includes placing the straw in a beverage reservoir of the beverage bottle with a distal end of the straw engaging a bottom of the beverage reservoir and a proximal end of the straw positioned in a spout of the beverage bottle. The distal end of the straw includes a resilient hinge configured to move between a bent position and an axial position. The method further includes opening a cap covering the spout such that the resilient hinge at the distal end of the straw moves from the bent position to the axial position and the proximal end of the straw extends outward from the spout.

The above described features and advantages, as well as others, will become more readily apparent to those of ordinary skill in the art by reference to the following detailed description and accompanying drawings. While it would be desirable to provide a straw for a beverage bottle that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

Figure 1A:
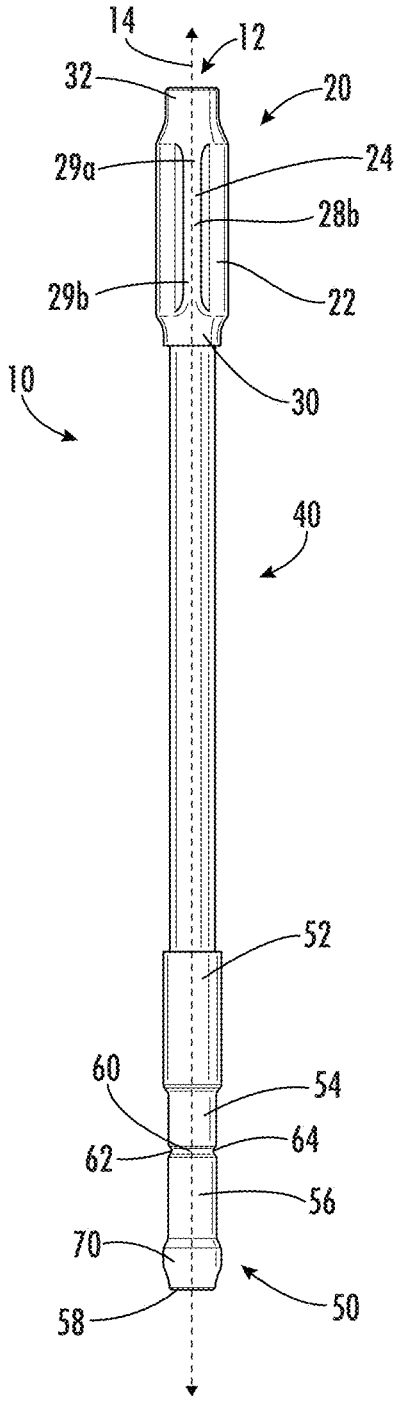
FIG. 1A is a first side view of a dynamic straw for use in association with a water bottle.
Figure 1B:
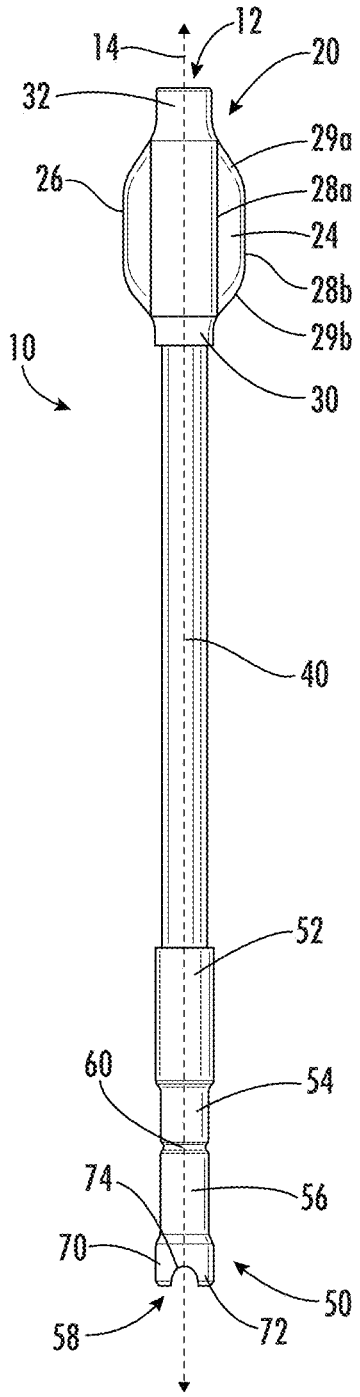
FIG. 1B is a second side view of the straw of FIG. 1A with the straw rotated ninety degrees from the first side view.
Figure 1C:
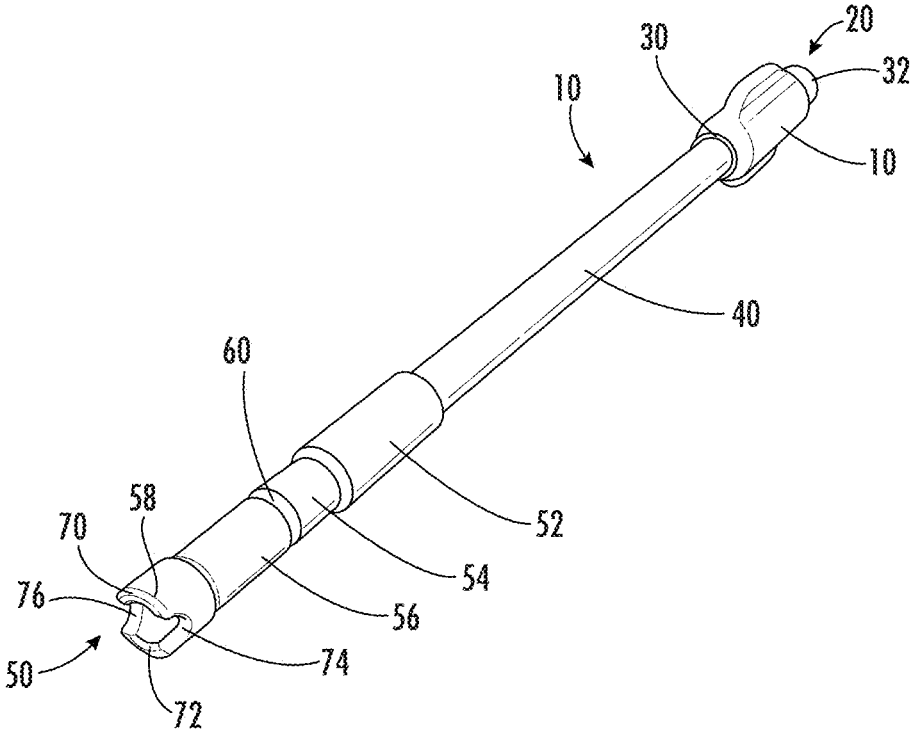
FIG. 1C is a distal end perspective view of the straw of FIG. 1A.
Figure 1D:
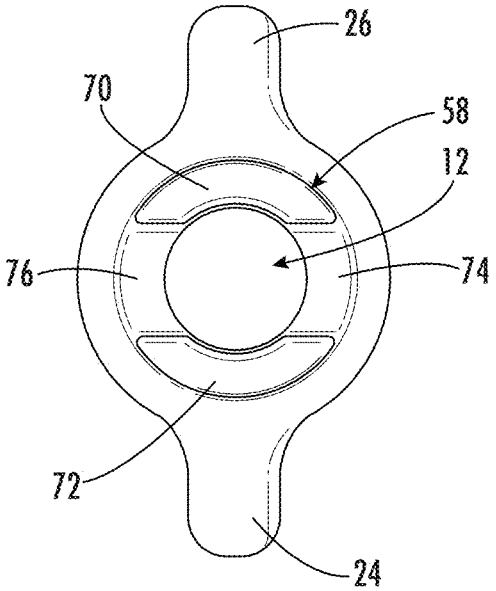
FIG. 1D is a distal end view of the straw of FIG. 1A.
Figure 1E:
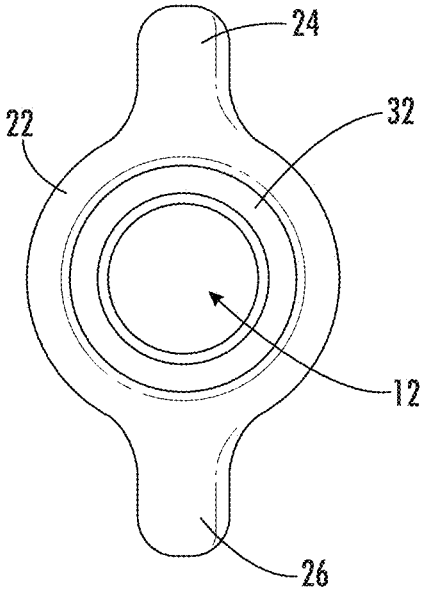
FIG. 1E is a proximal end view of the straw of FIG. 1A.

All Figures @ Under Armour, Inc. 2023. All rights reserved.

DESCRIPTION

In the following detailed description of a dynamic straw, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made, without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

It will be recognized that although the dynamic straw may be placed in any number of orientations during times of use and non-use, terms of position used herein in association with the straw are defined with reference to the straw being in a typical upright position during use (i.e., a generally upright position wherein a user sucks liquid upward through the straw). Accordingly, "vertical" references a direction that is generally perpendicular to the ground. Similarly, "horizontal" and/or "lateral" references a direction that is generally parallel to the ground). Likewise, the terms "above" and "upper" references a relative position where one component is vertically higher than another component, and "below" or "lower" references a relative position where one component is vertically lower than another component.

As described in greater detail below, embodiments disclose a water bottle including a body and a lid with a spout. The water bottle further includes a cap that selectively covers the spout. A straw is positioned through the spout such that it is in fluid communication with a fluid reservoir within the body. A portion of the straw is formed as scissor spring operable to move from a compressed or folded state to an expanded or unfolded state. In the expanded state, a first or bottom end of the straw is positioned within the reservoir while the second or top end protrudes from the spout opening. In the compressed state, the scissor spring folds, causing the top end of the straw to be urged downward, toward the reservoir until the top end no longer protrudes from the spout (i.e., the top end is either flush or positioned lower than the spout opening). With this configuration, when a user selective closes the spout by placing the cap thereon, the straw is urged downward from an active, drinking position to an inactive, storage position.

A dynamic straw 10 and water bottle 80 are disclosed herein. The dynamic straw 10 includes a resilient hinge 60 on a distal end that allows the straw to move from a bent position to an extended position. When the resilient hinge 60 is in the extended position, a drinking tip on a proximal end of the straw 10 is positioned above a spout of the water bottle 80. When the resilient hinge is in the bent position, the drinking tip of the straw is withdrawn into the spout of the water bottle 80.

Dynamic Straw

With reference to FIGS. 1A-1E, several views of the dynamic straw 10 are shown. The straw 10 may be in the form of an elongated hollow cylinder defining a proximal end portion 20 (terminating in proximal opened end 21), an elongated central portion 40 and a distal end portion 50 (terminating in distal opened end 51). The proximal end, 20, central portion 40, and distal end 50 are provided as three different pieces that are coupled together to form the straw 10. The proximal end 20 is fixedly coupled to one end of the elongated central portion 40. The distal end 50 is removable from and rotatably coupled to an opposite end of the elongated central portion 40. The straw 10 defines an axial passage 12 (also called a channel) that extends through the straw 10 from the proximal end 20 to the distal end 50 and allows liquid to pass therethrough.

The proximal end 20 of the straw 10 includes an enlarged portion 22 positioned between a coupling portion 30 and a drinking tip 32. A cylindrical cavity extends through the proximal end 20 from the coupling portion 30 to the drinking tip 32 and forms part of the axial passage 12 of the straw 10. The coupling portion 30 is cylindrical in shape and is fixedly coupled to the central portion 40 of the straw. The drinking tip 32 is also cylindrical in shape and provides an opening to the axial passage that is configured to allow a user to drink from the straw 10.

The enlarged portion 22 on the proximal end 20 of the straw 10 is positioned between the coupling portion 30 and the drinking tip 32 and defines a generally bulbous shape that has a greater diameter than both the coupling portion 30 and the drinking tip 32 (wherein the diameter at any given location on the straw 10 is the greatest dimension across the straw in a direction perpendicular to the longitudinal direction defined by the central axis 14). In the embodiment disclosed herein, the enlarged portion 22 is provided by two vertical wings 24, 26 positioned on opposite sides of the axial passage. Each of the two wings 24, 26 defines a trapezoidal shape, including a long base **28*a* and short base 28*b* positioned parallel to the axial passage 12, along with a first leg 29*a* and second leg 29*b* that extend between the long base 28*a* and the short base 28*b*. A trapezoidal surface area is defined between the bases 28*a*, 28*b* and legs 29*a*, 29*b* on the opposing sides of each vertical wing 24, 26** (i.e., each wing includes a generally flat front trapezoidal surface and a generally flat rear trapezoidal surface—the front trapezoidal surface being parallel to the back trapezoidal surface).

The proximal end 20 of the straw 10 is a one-piece/monolithic component comprised of a polymer material such as polypropylene, polyethylene, polystyrene, polyvinyl chloride, polycarbonate or any of various other materials. In at least some embodiments, the proximal end 20 of the straw 10 is comprised of a metal material, such as aluminum or stainless steel.

The proximal end 20 of the straw 10 is fixedly coupled to one end of the elongated central portion 40 of the straw. The elongated central portion 40 is a cylindrical structure that defines a central axis 14 for the straw 10. A cylindrical cavity extends through the elongated central portion and forms part of the axial passage 12 through the straw 10. The central portion 40 of the straw 10 is a one-piece/monolithic component comprised of a polymer material such as polypropylene, polyethylene, polystyrene, polyvinyl chloride, polycarbonate or any of various other materials. In at least some embodiments, the central portion 40 of the straw 10 is comprised of a metal material, such as aluminum or stainless steel. While the proximal end 20 of the straw has been described herein as being fixedly coupled to the central portion 40 of the straw, in at least some embodiments, the proximal end 20 is releasably coupled to the central portion 40 in order to facilitate better cleaning of the straw.

The distal end 50 of the straw 10 is removably coupled to an end of the central portion 40 opposite the proximal portion 20. The distal end 50 of the straw 10 is a cylindrical structure that includes an upper cylindrical portion 52, a middle cylindrical portion 54, a lower cylindrical portion 56, a distal mouth 58, and a resilient hinge 60 positioned between the middle cylindrical portion 54 and the lower cylindrical portion 56. A cylindrical cavity extends through the distal end 50 and forms part of the axial passage 12 through the straw 10. Similar to the proximal end 20 and the central portion 40, the distal end 50 of the straw is also a one-piece/monolithic component comprised of a polymer material such as polypropylene, polyethylene, polystyrene, polyvinyl chloride, polycarbonate or any of various other materials.

With continued reference to FIGS. 1A-1E, the upper cylindrical portion 52 of the distal end 50 of the straw 10 is designed and dimensioned to receive the central portion 40 of the straw in a friction fit. The length of the upper cylindrical portion 52 is generally between 8 mm and 16 mm, and between 11 mm and 13 mm (i.e., about 12 mm) in at least some embodiments. This length provides a satisfactory coupling between the distal end 50 and the central portion 40 of the straw, while still allowing the distal end 50 to be removed from the central portion 40, as desired. Because the coupling between the distal end 50 and the central portion 40 is not fixed, the distal end 50 may be rotated relative to the central portion 40. While the distal end 50 of the straw 10 has been described herein as removably coupled to the central portion 40 (e.g., with a friction fit), in at least some embodiments the distal end 50 of the straw is fixedly coupled to the central portion 40 in order to prevent the distal end 50 from being removed and subsequently lost.

The middle cylindrical portion 54 of the distal end 50 is coaxial with but slightly smaller in diameter than the upper cylindrical portion 52 such that a shoulder is formed between the upper cylindrical portion 52 and the middle cylindrical portion on the distal end 50 of the straw 10. This shoulder provides a seat for the central portion 40 of the straw 10 when it is inserted into the upper cylindrical portion and prevents the central portion 40 of the straw from extending to the middle cylindrical portion 54 at the distal end 50 of the straw 10.

A resilient hinge 60 is provided on the distal end 50 of the straw 10 between the middle cylindrical portion 54 and the lower cylindrical portion 56. The resilient hinge 60 facilitates movement of the distal end 50 of the straw 10 between an extended position (see FIG. 3B) and a bent or folded position (see FIG. 3A). In the extended position (see FIG. 3B), the middle portion 54 is substantially aligned with the lower cylindrical portion 56 (as well as central portion 40 and proximal end 20) along the central axis 14 of the straw. These portions may be considered to be "substantially aligned" because the two portions are generally coaxial with an angle between the middle portion 54 and lower portion 56 at less than 10°. Accordingly, the extended position of the straw 10 may also be referred to herein as an "axial position." Conversely, in the bent position (see FIG. 3A), the middle portion 54 and the lower portion 56 are misaligned and not coaxial. For example, in the bent position, the angle between the middle portion 54 and the lower portion 56 is greater than 30°, such as 45°, 60° or 90°. Accordingly, the bent position of the straw 10 may alternatively be referred to herein as a "non-axial position."

In the embodiment disclosed herein, the resilient hinge 60 is provided by a living hinge formed on the distal end 50 of the straw 10 between the middle portion 54 and the lower portion 56. The hinge 60 may be considered a "living hinge" (or "integral hinge") because it is a thin flexible hinge (i.e., flexure bearing) made from the same material as the two rigid pieces it connects. In the disclosed embodiment, the resilient hinge is formed by a thinned section of the distal end 50 that allows lower portion 56 to bend relative to the middle portion 54 along the line of the hinge. In other words, the cross-sectional thickness of the cylindrical wall forming the distal end 50 is smaller at the resilient hinge 60 than at the middle portion 54 and the lower portion 56. This reduced thickness provides a natural bend location that allows the living hinge to bend with minimal friction and very little wear.

In at least one embodiment, the resilient hinge is defined by two opposing semi-circular arc portions 62, 64 formed on opposite sides of the cylindrical structure of the distal end 50. The two opposing semi-circular arc portions 62, 64 are oriented about the central axis 14 and are thus arranged in a plane that is perpendicular to the axis. The respective ends of the two semi-circular arc portions meet at two points on opposite sides of the hinge 60. Because the two semi-circular arc portions do not span a full 180°, they do not form a full circle. This configuration results in two opposing points that define a natural bend line for the hinge 60.

The polymer material used to form the distal end 50 of the straw 10 is elastomeric. As a result, the hinge 60 is inherently resilient. The hinge 60 is specifically configured to bias the distal end 50 toward the axial position (see FIG. 3B). The hinge is only moved to the bent position (see FIG. 3A) when a force is applied to the straw that causes the hinge 60 to bend. When the force is removed, the resilient hinge 60 returns to the axial position (an equilibrium position). As explained in further detail below, the dynamic straw 10 thus has specific advantages when used in combination with a water bottle.

The lower cylindrical portion 56 of the straw 10 is positioned below the resilient hinge 60. The lower cylindrical portion 56 has the same diameter of the middle cylindrical portion 54, and is generally coaxial with the middle cylindrical portion 54 when the straw is in the axial position. When the straw 10 is in the bent position, the lower cylindrical portion 56 is not aligned with middle cylindrical portion 54 (e.g., the lower cylindrical portion 54 may be bent 90° relative to the middle cylindrical portion 56).

The distal mouth 58 of the straw 10 is provided along a lowermost perimeter of the distal end 50. The distal mouth 58 defines two opposing arcuate lips 70, 72 separated by two opposing concavities 74, 76. The distal mouth 58 is configured to receive water or other liquids that are pulled into the straw via suction provided by a user at the drinking tip 32. The two opposing concavities 74, 76 provide the distal mouth 58 with an uneven tip perimeter such that the entrance to the straw 10 and the associated axial passage 12 is not completely blocked if an object such as ice or the bottom of a water bottle is moved into abutment with the distal mouth 58. In other words, while the distal mouth 58 allows for liquid to enter through the straw in the axial direction, the opposing concavities 74, 76 of the distal mouth 58 provide further passages into the straw from a direction that is perpendicular to the central axis.

Water Bottle

Figure 2:
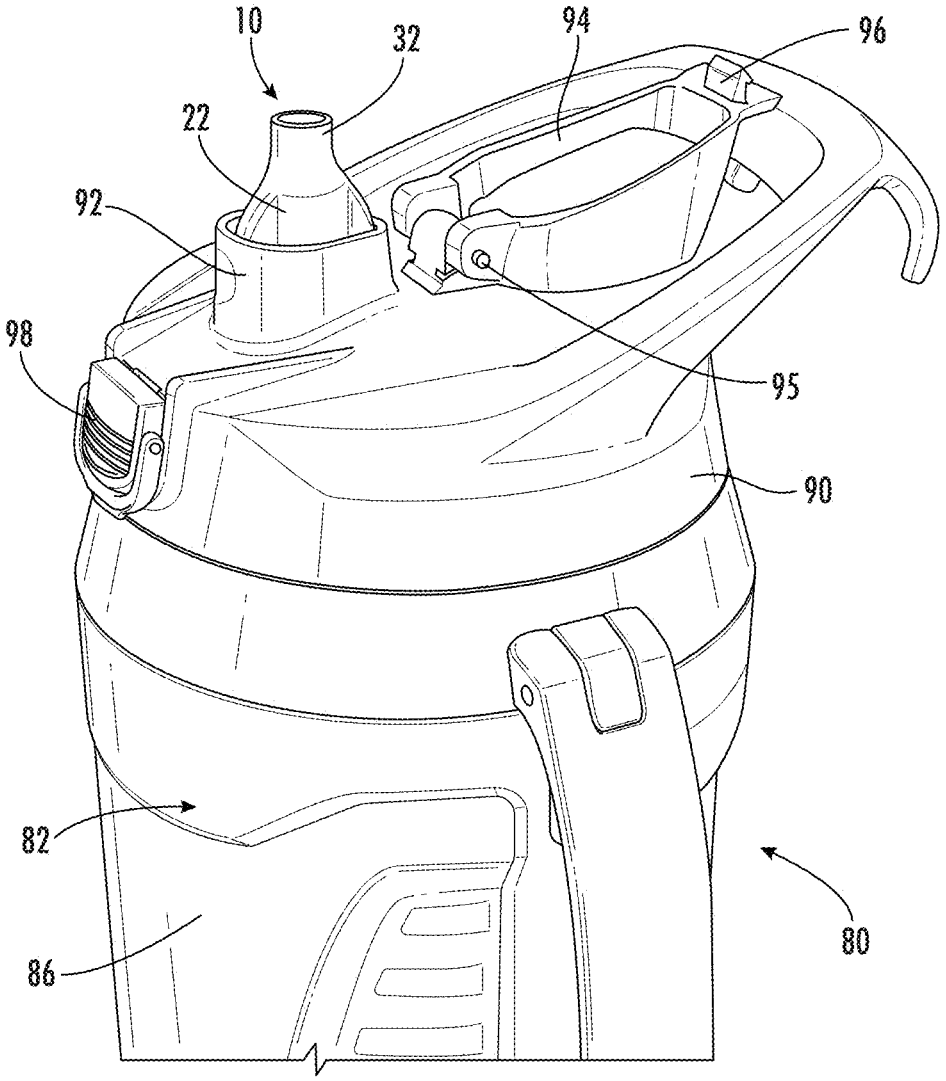
FIG. 2 shows a perspective view of the dynamic straw of FIG. 1A positioned in a water bottle.
Figure 3A:
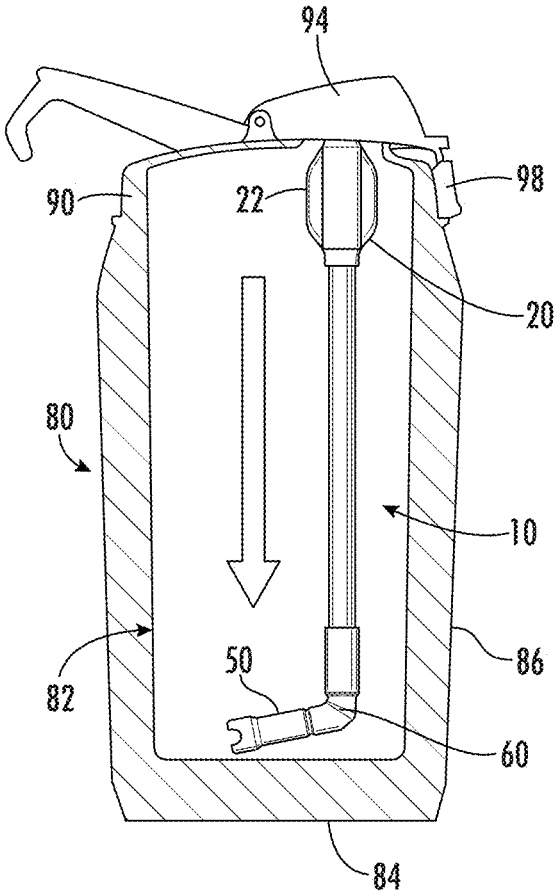
FIG. 3A is a cross-sectional view of the water bottle of FIG. 2 illustrating a cap of the water bottle closed and the dynamic straw in a bent position within the water bottle.
Figure 3B:
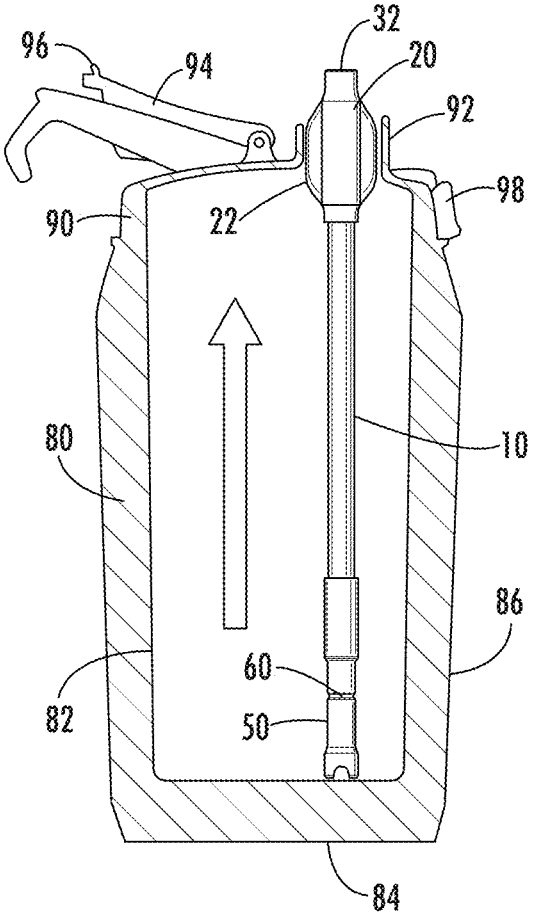
FIG. 3B is a cross-sectional view of the water bottle of FIG. 2 illustrating the cap of the water bottle open and the dynamic straw in an axial position within the water bottle.

With reference now to FIGS. 2-3B, the dynamic straw 10 is configured for use with a beverage bottle 80 comprising a liquid reservoir 82 and a lid 90 with a spout 92. The liquid reservoir 82 may be provided in any of various typical configurations for a water bottle. For example, the liquid reservoir may be a generally cylindrical container with a relatively flat bottom portion 84, circular sidewalls 86, and a removable lid 90. The flat bottom portion 84 allows the bottle 80 to lie flat against a flat surface and stand upright without the need for additional support. The circular sidewalls 86 are integrally formed with the flat bottom portion 84 and extend upwardly therefrom, thus defining a volume for the liquid reservoir 82. Typical volumes for the liquid reservoir include sixteen ounces, thirty-two ounces, sixty-four ounces, or more, but it will be recognized that the liquid reservoir may define any number of different volumes in different embodiments. Also, while the liquid reservoir 62 has been described herein as being generally cylindrical with circular sidewalls, any number of different shapes of the liquid reservoir are contemplated in association with other embodiments of the water bottle 80. The liquid reservoir may also be formed from any of various materials commonly used for water bottles, such as polypropylene resin, high density polyethylene (HDPE), low density polyethylene (LDPE), glass, stainless steel, aluminum, and any of various other materials.

The removable lid 90 is releasably coupled to a coupling feature at an upper end of the water bottle 80. In the disclosed embodiment, the removable lid 90 includes internal threads that engage complementary threads on an outer side of the upper end of the water bottle 80. In other embodiments, the removable lid 90 may be differently coupled to the upper end of the water bottle 80, such as by a snap-fit, a clamping mechanism, or any of various other coupling features. The removable lid 90 may be comprised of a same or similar material to that of the liquid reservoir 82.

The spout 92 is integrally formed with the removable lid 90. The spout 92 extends upwardly on an outer surface/ceiling of the removable lid and defines a walled chamber. The walled chamber of the spout 92 that provides a corridor/passage into (and out of) the liquid reservoir 82. The passage defined by the spout 92 is elongated relative to the thickness of the ceiling of the lid 90. For example, the passage defined by the spout may have a length of 0.35 to 1.5 inches, while the nominal thickness of the lid ceiling may be 0.05 to 0.25 inches. The walled chamber formed by the spout 92 has a teardrop upper perimeter shape and cross-sectional shape from top to bottom. This teardrop shape includes a radially inward curve defined by a first radius and a radially outward curve defined by a second radius, wherein the second radius is greater than the first radius. For example, the inward/first radius may be 0.1 to 0.2 inches, while the outward/second radius may be between 0.2 to 0.4 inches. The outward curve configures the spout 92 for pouring when the water bottle 80 is tipped sideways.

The lid 90 further includes a cap 94 provided on the upper surface of the lid 90. The cap 94 is configured to move between a closed position (see FIG. 3A) and an open position (see FIG. 3B). In the closed position, the cap 94 completely covers the top/upper perimeter of the spout 92 and conceals the spout 92 on the top of the lid 90. In the open position, the cap 94 is completely removed from the top/upper perimeter of the spout 92 such that the spout 92 is exposed on the top of the lid 90. A spring 95 biases cap 94 toward the open position.

The cap 94 includes a detent 96 configured to engage a cap release mechanism 98. In the disclosed embodiment, the cap release mechanism 98 is provided a pivotable lever/button with an upper lip configured to engage the detent 96 of the cap 94. The upper side of the cap release mechanism 98 biased inward such that the upper lip engages the detent 96 and retains the cap 94 in the closed position. When a bottom side of the cap release mechanism 98 is depressed by a user, the upper lip of the pivotable lever/button is removed from the detent, and the spring 95 pivots the cap 94 away from the spout 92 and to the open position. The cap 94 may further include a seal or plug that engages the spout and prevents water leakage from the liquid reservoir 82 if the water bottle 80 is tipped when the cap 94 is in the closed position.

As shown in FIGS. 2-3B, the above-described dynamic straw 10 is configured for placement within the water bottle 80. Specifically, the straw 10 is configured for insertion through the spout 92 such that the distal end 50 of the straw 10 engages the interior bottom surface of the liquid reservoir 82, and the proximal end 20 of the straw 10 extends through the spout 92 on the lid 90 of the water bottle. When the distal end 50 of the straw 10 is in the axial position (see FIG. 3B), the axial length of the straw 10 is greater than the length of the water bottle 80 from the interior bottom surface of the liquid reservoir 82 to the top outer perimeter of the spout 92. Thus, when the distal end 50 of the straw 10 is in the axial position and the bulbous proximal end of the straw is arranged with in the spout 92, the proximal end 20 of the straw 10 extends completely through the spout 92 and the drinking tip 32 is exposed above the spout 92. However, when the distal end 50 of the straw 10 is in the bent position (e.g., with an bend of approximately 90° as shown in FIG. 3A), the length of the straw 10 is shortened, and the straw 10 may be arranged such that the proximal end 20 of the straw extends into but not completely through the spout 92, and the drinking tip 32 is positioned below the upper perimeter of the spout 92.

Method of Using Dynamic Straw and Water Bottle

With reference again to FIGS. 3A and 3B, a method of using the dynamic straw 10 in combination with the water bottle is illustrated. As shown in FIG. 3A, the dynamic straw 10 is positioned within the liquid reservoir 82 of the water bottle 80 with the cap 94 in a closed and locked position (i.e., the detent of the cap engages the cap release mechanism 98). With the cap 94 closed and covering the spout 92, the distal end 50 of the straw 10 is in a bent position at the bottom of the liquid reservoir 82, and the drinking tip 32 at the proximal end 20 of the straw 10 is withdrawn into the spout 92. Because the cap 94 completely covers the upper perimeter of the spout 92, the resilient hinge 60 at the distal end 50 of the straw 10 is maintained in the bent position, and the proximal end 20 of the straw 10 is maintained in the withdrawn position within the spout 92.

When a user presses the cap release mechanism 98, the detent 96 of the cap 94 is released from engagement with the cap release mechanism 98, and the spring 95 moves the cap 94 to the open position, as shown in FIG. 3B. With the cap 94 removed from the spout 92, the resilient hinge 60 urges the distal end 50 of the straw 10 from the bent position of FIG. 3A to the axial position of FIG. 3B. This forces the proximal end 20 of the straw 10 upwardly. Advantageously, the uniquely shaped enlarged portion 22 including the trapezoidal wings 24, 26 at the proximal end 20 of the straw 10 cooperates with the spout 92 to properly align the straw 10 as it moves upwardly through the spout 92. Thus, the enlarged portion 22 of the straw 10 serves as an alignment guide for the straw 10 that places the straw in a predetermined orientation within the spout and prevents the straw from getting hung-up or caught by any surfaces that would prevent upward movement of the straw 10. When the distal end 50 of the straw is fully moved to the axial/extended position, the proximal end 20 of the straw is positioned a sufficient distance into the spout 92 such that the drinking tip 32 is positioned above the spout 92. The user may then easily access the drinking tip 32 and suck on the end of the straw 10 in order to draw liquid from the liquid reservoir into their mouth for drinking.

After using the straw in the extended position for drinking, the user may then choose to close the water bottle for later use. In order to do this, the user pivots the cap 94 back to the closed position covering the spout 92 such that the detent 96 of the cap 94 engages the cap release mechanism 98 and locks the cap 94 in place covering the spout 92. As the cap 94 is moved to this closed position, the inner upper surface of the cap engages the drinking tip 32 of the straw and forces it downward and into the spout 92. As the proximal end 20 of the straw is forced downward, the resilient hinge 60 flexes and is forced into the bent position (see FIG. 3A). In this position, the water bottle 80 is closed with the drinking tip of the straw completely covered within the spout. This closed position has the advantage of providing a sanitary covering for the straw 10 when the water bottle 80 is not in use. This closed position has the further advantage of blocking leakage of liquid from the spout 92 if the water bottle 80 is tipped over when not in use.

The above-described method of using the dynamic straw 10 with the water bottle 80 may be repeated again and again as the cap 94 is moved between the open position and the closed position on the lid 90. The structural features of the straw 10, including the enlarged portion 22 of the proximal end 20, the rotatable distal end 50, and the resilient hinge 60 provide numerous advantages when the straw 10 is used in combination with the water bottle 80. For example, as noted above the enlarged portion 22 of the proximal end 20 serves as an alignment guide for the proximal end when moving through the spout 92. As another example, because the distal end 50 of the straw is rotatable with respect to the elongated central portion 40 and the proximal end 20, the user may remove the straw from the water bottle, as needed, and adjust the orientation of the resilient hinge 60 with respect to the enlarged portion 22 (e.g., the bend axis of the hinge 60 either parallel or perpendicular to the plane defined by the trapezoidal surface of the wings 24, 26). The user may find that one orientation of the hinge 60 relative to the wings of the enlarged portion 22 results in better cooperation between the enlarged portion and the spout 92 when the straw is moved between the bent position and the axial position.

Although the various embodiments have been provided herein, it will be appreciated by those of skill in the art that other implementations and adaptations are possible. Furthermore, aspects of the various embodiments described herein may be combined or substituted with aspects from other features to arrive at different embodiments from those described herein. Thus, it will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A beverage bottle comprising:
a liquid reservoir defining an upper end and a lower end;
a spout positioned at the upper end of the liquid reservoir; and
a straw extending from the upper end to the lower end of the liquid reservoir, the straw including a proximal end and a distal end with an elongated portion extending between the proximal end and the distal end, the proximal end of the straw configured to extend through the spout and the distal end of the straw configured to engage the lower end of the liquid reservoir, the distal end of the straw including a resilient hinge moveable between an axial position and a bent position, wherein the proximal end of the straw extends through the spout when the resilient hinge is in the axial position, wherein the proximal end of the straw is withdrawn into the spout when the resilient hinge is in the bent position, and wherein the resilient hinge is biased toward the axial position, wherein the proximal end of the straw includes an enlarged portion and a drinking tip, the enlarged portion having a bulbous shape with a greater diameter than both the drinking tip and the elongated portion of the straw, the enlarged portion providing a spout alignment guide configured to retain the straw in a predetermined orientation within the spout.

2. The beverage bottle of claim 1 further comprising a cap configured to cover the spout, the cap configured to move between an open position and a closed position, wherein the proximal end of the straw extends outwardly past the spout when the cap is in the open position, and wherein the proximal end of the straw is at least partially withdrawn into the spout when the cap is in the closed position.

3. The beverage bottle of claim 2 wherein the proximal end of the straw is fully withdrawn into the spout when the cap is in the closed position.

4. The beverage bottle of claim 2 wherein the cap is biased toward the open position.

5. The beverage bottle of claim 4 further comprising a cap release mechanism, the cap including a detent configured to engage the cap release mechanism, wherein activation of the cap release mechanism when the cap is in the closed position releases the detent and allows the cap to move to the open position such that the straw moves through the spout.

6. The beverage bottle of claim 5 further comprising a lid releasably coupled to the upper end of the liquid reservoir, wherein the spout, the cap, and the cap release mechanism are positioned on the lid.

7. A combination beverage bottle and straw comprising:
a beverage bottle comprising:
a liquid reservoir defining an upper end and a lower end; and
a spout positioned at the upper end of the liquid reservoir; and
a straw positioned in the beverage bottle and extending from the upper end to the lower end of the liquid reservoir, the straw comprising:
a proximal end including an enlarged portion and a drinking tip, the enlarged portion providing a spout alignment guide configured to retain the straw in a predetermined orientation within the spout, the enlarged portion having a bulbous shape with a greater diameter than the drinking tip;
an elongated central portion coupled to the proximal end, the elongated central portion defining an axis and having a smaller diameter than the drinking tip at the proximal end of the straw; and a distal end coupled to the elongated central portion and configured to engage the lower end of the liquid reservoir, the distal end including a resilient hinge configured to permit the distal end to move between an axial position and a bent position, wherein the proximal end extends through the spout and the distal end is substantially aligned with the axis when in the axial position, wherein the proximal end is withdrawn into the spout and the distal end is misaligned with the axis when in the bent position, and wherein the resilient hinge is biased toward the axial position.

8. The combination beverage bottle and straw of claim 7 wherein the distal end is a monolithic cylindrical structure comprised of a polymer, and wherein the resilient hinge is a living hinge formed in the cylindrical structure.

9. The combination beverage bottle and straw of claim 8 wherein the distal end is rotatable with respect to the elongated central portion.

10. The combination beverage bottle and straw of claim 9 wherein the living hinge includes two opposing semi-circular portions formed in the cylindrical structure, the two opposing semi-circular portions arranged in a plane that is perpendicular to the axis.

11. The combination beverage bottle and straw of claim 7 wherein the distal end of the straw includes a mouth of the straw defining two opposing arcuate lips separated by two opposing concavities.

12. The combination beverage bottle and straw of claim 7 wherein the distal end is removably coupled to the elongated central portion.

13. The combination beverage bottle and straw of claim 7 wherein the enlarged portion of the proximal end includes an axial passage and two wings positioned on opposite sides of the axial passage.

14. The combination beverage bottle and straw of claim 13 wherein each of the two wings defines a trapezoidal shape.

15. A method of making a straw available for use in drinking from a beverage bottle, the method comprising:

placing the straw in a beverage reservoir of the beverage bottle with a distal end of the straw engaging a bottom end of the beverage reservoir, a proximal end of the straw positioned in a spout at an upper end of the beverage bottle, and an elongated portion extending between the distal end and the proximal end of the straw, the distal end of the straw including a resilient hinge configured to move between a bent position and an axial position, wherein the proximal end of the straw is configured to extend through the spout when the resilient hinge is in the axial position, wherein the proximal end of the straw is configured to be withdrawn into the spout when the resilient hinge is in the bent position, and wherein the resilient hinge is biased toward the axial position, the proximal end of the straw including an enlarged portion and a drinking tip, the enlarged portion having a bulbous shape with a greater diameter than both the drinking tip and the elongated portion of the straw, the enlarged portion providing a spout alignment guide configured to retain the straw in a predetermined orientation within the spout; and opening a cap covering the spout such that the resilient hinge at the distal end of the straw moves from the bent position to the axial position and the proximal end of the straw extends outward from the spout.

16. The method of claim 15 wherein the proximal end of the straw includes a drinking tip, wherein the drinking tip moves from a withdrawn position in the spout to an extended position outside of the spout when the cap is opened.

17. The method of claim 16 further comprising drinking from the straw when the drinking tip is in the extended position.

18. The method of claim 17 further comprising closing the cap such that the drinking tip is forced to the withdrawn position and the resilient hinge moved to the bent position.

* * * * *